US008919620B2

(12) United States Patent
Taylor et al.

(10) Patent No.: US 8,919,620 B2
(45) Date of Patent: Dec. 30, 2014

(54) LONG HANDLED SOCK DONNING TOOL AND METHOD OF USE

(71) Applicants: Kevin Darrell Taylor, Farr West, UT (US); Michael Phillip Taylor, Farr West, UT (US)

(72) Inventors: Kevin Darrell Taylor, Farr West, UT (US); Michael Phillip Taylor, Farr West, UT (US)

( * ) Notice: Subject to any disclaimer, the term of this patent is extended or adjusted under 35 U.S.C. 154(b) by 0 days.

(21) Appl. No.: 13/794,992

(22) Filed: Mar. 12, 2013

(65) Prior Publication Data

US 2014/0263486 A1 Sep. 18, 2014

(51) Int. Cl.
*A47G 25/80* (2006.01)
*A47G 25/90* (2006.01)

(52) U.S. Cl.
CPC ..... *A47G 25/905* (2013.01)
USPC ..... 223/111; 223/112; 223/118

(58) Field of Classification Search
CPC ..... A47G 25/80; A47G 25/82; A47G 25/90; A47G 25/905; A47G 25/907; A47G 25/908
USPC ..... 223/111, 112, 113, 118, 119
See application file for complete search history.

(56) References Cited

U.S. PATENT DOCUMENTS

| | | | | |
|---|---|---|---|---|
| 3,310,209 | A | 3/1967 | Clauss | |
| 3,604,604 | A | 9/1971 | Ahn | |
| 3,991,920 | A * | 11/1976 | Hall | 223/111 |
| 4,638,932 | A * | 1/1987 | Keller | 223/111 |
| 4,943,097 | A * | 7/1990 | Sanger | 223/111 |
| 5,924,610 | A * | 7/1999 | Willemin | 223/112 |
| 6,056,171 | A * | 5/2000 | Santamaria | 223/112 |
| 6,283,342 | B1 * | 9/2001 | Wilkerson | 223/112 |
| 6,942,129 | B2 * | 9/2005 | Ferraioli | 223/113 |
| 2011/0049201 | A1 * | 3/2011 | Bertinotti | 223/112 |
| 2012/0228343 | A1 | 9/2012 | Brobeg | |

FOREIGN PATENT DOCUMENTS

| | | |
|---|---|---|
| FR | 2814930 | 4/2002 |
| GB | 2221604 | 8/1988 |
| JP | 2008264445 | 6/2008 |
| JP | 2011147737 | 4/2011 |

* cited by examiner

*Primary Examiner* — Nathan Durham
(74) *Attorney, Agent, or Firm* — Dowell & Dowell, PC

(57) ABSTRACT

A long handled sock donning tool includes a handle portion adapted to be gripped by a user and an opposing sock engaging portion. The sock engagement portion includes first and second flanges spaced from an elongated support by first and second spacers. Each of the flanges include a sock engagement arm for retaining a sock thereon, and an opposing stabilizing arm for supporting the tool during the mounting of the sock onto the tool. First and second rubber sock gripping portions help retain the sock on the tool. Once an upper portion of a sock is folded over the sock gripping portions, a user's foot can be inserted into the sock comfortably without being forced into contact with a hard plastic wall of the tool. Additionally, the tool can be used as a shoe horn by fitting one of the first and second flanges into the heel of a shoe.

13 Claims, 7 Drawing Sheets

LONG HANDLED SOCK DONNING TOOL AND METHOD OF USE

BACKGROUND OF THE INVENTION

1. Field of the Invention

The present invention pertains to the art of medical aid devices, and more particularly to sock or hosiery donning tools.

2. Discussion of the Prior Art

People with back, knee and hip problems, people with decreased flexibility, pregnant women, or people who are overweight, have a hard time bending over far enough to put on their socks and hosiery.

In general, it is known in the art to have a long handled tool for aiding a user in putting on hosiery or socks, wherein the tool comprises flanges about which a user fits the top of a sock such that the top of the sock is held in an open position to receive the foot of a user, as demonstrated by at least U.S. Patent Application Publication No. 2011/0049201. However, such devices fail to provide an adequate gripping structure to maintain socks in place during insertion of a user's foot. Further, the manner in which such devices are utilized blocks the user's view of the foot as it is being inserted into hosiery. It is also known to fold the top of a stocking over a stocking holding portion of a device, and slide a foot into the open end of the stocking, as demonstrated by U.S. Pat. No. 7,070,074. However, the '074 device is large, and is not easily portable. Therefore, there exists a need in the art for an improved hand-held sock donning apparatus that is easily utilized, facilitates retention of socks during use, and allows easy disengagement of a donned sock and that can be utilized as a shoe horn.

SUMMARY OF THE INVENTION

The present invention is directed to a long handled sock donning tool including an elongated support. A handle portion adapted to be gripped by a user extends from a first end of the elongated support, while a sock engaging portion extends from a second end of the support. The sock engagement portion includes first and second spacers extending from opposing sides of the elongated support. First and second flanges are spaced from the elongated support by the first and second spacers. Each of the first and second flanges include a sock engagement arm for retaining a sock thereon, and an opposing stabilizing arm for supporting the tool during the mounting of the sock onto the tool. First and second rubber sock gripping portions extend over respective sock engagement arms to aide in retention of the sock on the tool. Preferably, the elongated support, handle and sock engagement portion, are made from a single unitary piece of lightweight plastic material.

First and second opposing flanges and first and second spacers define a space there between for the insertion of a user's foot. The structure allows for stretching of a mounted sock in all directions such that the foot of a user can be inserted into the sock comfortably without being forced into contact with a hard plastic wall of the tool.

Ergonomic features of the tool include contoured ridges adapted to be engaged by the fingers of a user and a ribbed thumb grip to help a user hold the handle portion securely when utilizing the tool to don a sock. Additionally, a pair of parallel slots formed along the length of the elongated support can be utilized to display the tool or secure labels or other packaging material to the tool.

In use, a user initially rests the opposing stabilizing arms on an upper portion of their thigh. The distance between first and second flanges enables the tool to rest in a stable manner on the user's thigh. At the same time, the handle portion rests against the torso of the user. With the tool thus secured, a user then positions a sock between the first and second flanges and, stretching the sock gently, folds an outer upper portion of the sock over the first and second sock gripping portions, such that the sock is secured to the tool only through the upper folded portion of the sock. Next, gripping the handle portion, a user extends the tool and, with minimal bending, slides his or her toes through an opening of the sock. The user then pulls the handle portion towards their torso while sliding their foot down into the sock, thereby donning the sock. When the sock is positioned on the user's foot to their satisfaction, the user simply pivots the handle portion forward, whereby the sock gripping portions slide out from under the outer upper portion of the sock, thereby releasing the sock from the tool.

In an alternative mounting method, the tool is placed between a user's thighs and the user squeezes the first and second flanges towards one another with their thighs. The flexible nature of the sock engaging portion enables the flanges to be brought closer together to make it easier for a user to mount the sock onto the tool. Once the sock is mounted, the user proceeds with putting on the sock as outlined above.

An additional benefit of the present invention is the ability of the tool to be utilized as a shoe horn. More particularly, a user may insert one of the flanges into a shoe, and slide their heel down the outer surface of the flange until their heel is within the shoe, and then remove the flange.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
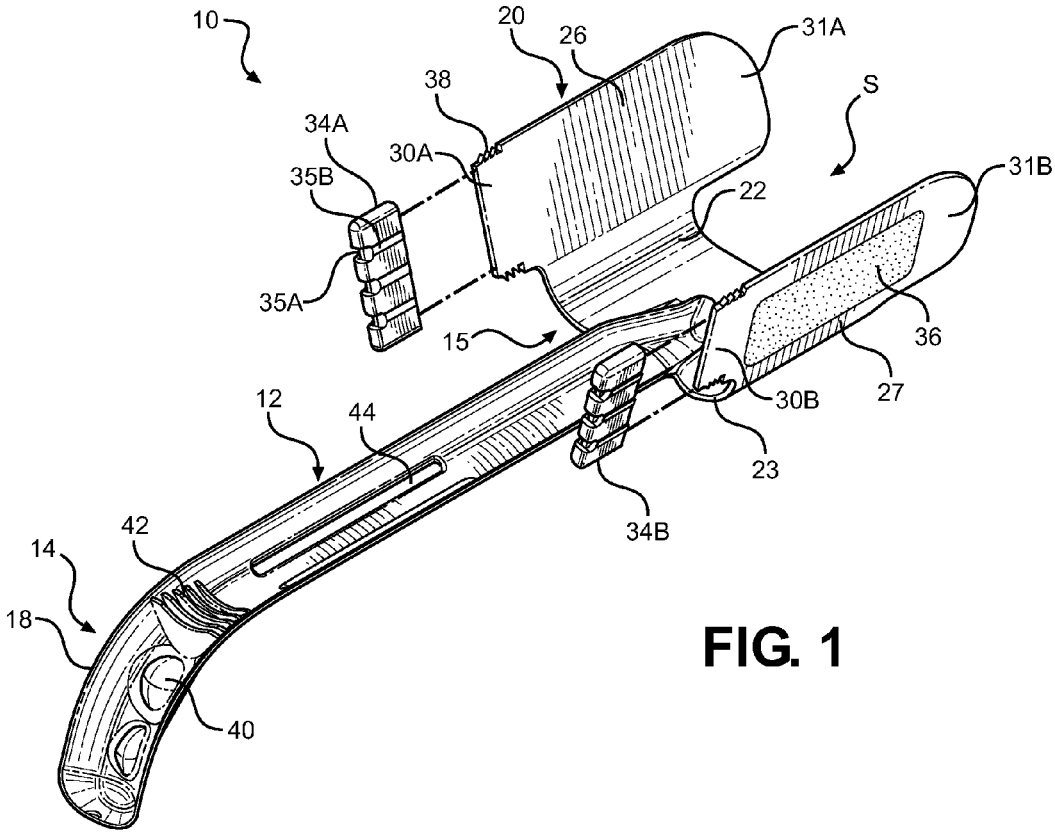
FIG. 1 is an exploded, perspective view of the long handled sock donning tool of the present invention.
Figure 2:
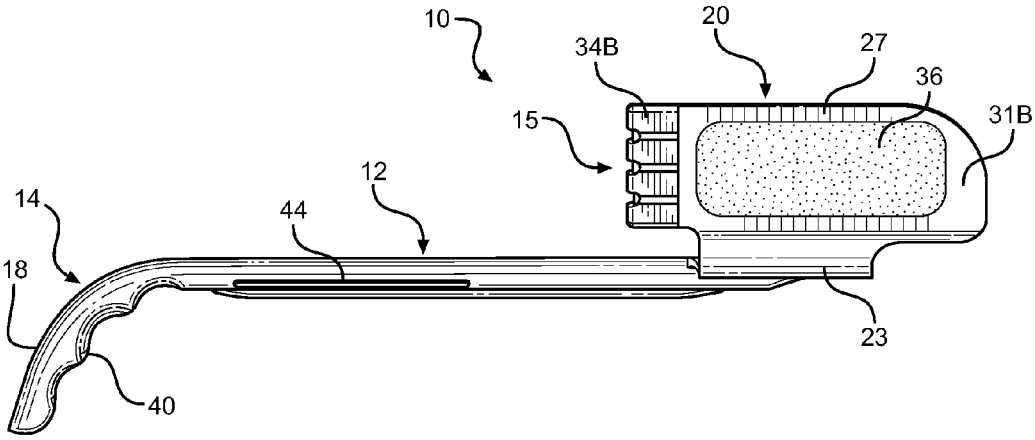
FIG. 2 is a side view of the assembled tool of FIG. 1.

With initial reference to FIGS. 1 and 2, a long handled sock donning tool of the present invention is shown at 10. It should be understood that the term "sock" as used herein is intended to encompass socks, stockings, hosiery, and the like. Tool 10 includes an elongated support 12 having opposing first and second ends indicated at 14 and 15. A handle portion 18, adapted to be gripped by a user, extends from first to end 14 of elongated support 12. In one embodiment, elongated support 12 has a length of approximately 17.5 inches (44.45 cm), which allows a user to easily utilize tool 10 with limited bending. A sock engaging portion 20 extends from second end 15 of elongated support 12, and includes first and second spacers 22 and 23 extending from opposing is sides of second end 15. In a preferred embodiment, spacers 22 and 23 are slightly curved. Additionally, first and second flanges 26 and 27 extend at an angle from respective first and second spacers 22 and 23, such that first and second flanges 26 and 27 are spaced from elongated support 12 by first and second spacers 22 and 23. Each of first and second flanges 26 and 27 include a sock engagement arm shown at 30*a* and 30*b*, and an opposing stabilizing arm shown at 31*a* and 31*b*. In one embodiment, each of the first and second flanges 26 and 27 has a length of approximately 6 inches (15.24 cm). First and second sock gripping portions 34*a* and 34*b* extend over respective sock engagement arms 30*a* and 30*b*. Sock gripping portions 34*a* and 34*b* may be rubber, or other soft, high friction material that aids in retention of socks. Preferably, sock gripping portions 34*a* and 34*b* are formed with ridges 35*a* and channels 35*b* therein, to aide in the sock retention and removal process described below.

In the embodiment shown, a main body portion defined by elongated support 12, handle 18 and sock engagement portion 20, is made from a single unitary piece of lightweight material. Preferably, the main body portion is made from a rigid, injection moldable plastic, such as acrylonitrile butadiene styrene (ABS), or similar material. The outer walls of flanges 31*a* and 31*b* may include a textured portion indicated at 36 to reduce slippage when squeezing the flanges 31*a* and 31*b* between a user's thighs, as will be discussed in more detail below. The result is a lightweight, yet strong and stable tool 10. After formation of the main body portion, sock gripping portions 34*a* and 34*b* are friction fit about respective sock engagement arms 30*a* and 30*b*. In the preferred embodiment shown, first and second sock engagement arms 30*a* and 30*b* is are each formed with a plurality of mounting teeth 38, which aid in retaining first and second sock gripping portions 34*a* and 34*b* on respective sock engagement arms 30*a* and 30*b*.

As can be seen in FIGS. 1 and 2, sock engagement arms 30*a*, 30*b* and opposing stabilizing arms 31*a*, 31*b*, extend beyond respective first and second spacers 22 and 23. With this configuration, the first and second spacers 22 and 23, and their respective sock engagement arms 30*a*, 30*b* and opposing stabilizing arms 31*a*, 31*b*, form a general t-shape. First and second opposing flanges 26 and 27, and first and second spacers 22 and 23, define a space S there between for the insertion of a user's foot. Preferably, the distance between first and second flanges 26 and 27 is at least 5 inches (12.7 cm) to allow for adequate foot space, and to enable tool 10 to be supported in a stable manner on a user's thigh, as will be discussed in more detail below.

Elongated support 12 is formed with a curved, generally u-shaped cross section for stability. Further, an underside of handle portion 18 is formed with a plurality of ergonomic contoured ridges 40 adapted to be engaged by the fingers of a user. Additionally, a plurality of panels extend between opposing inner walls of the u-shaped elongated support 12 to form a ribbed thumb grip indicated at 42. It should be understood that ribbed thumb grip provides traction to help a user hold handle portion 18 securely when utilizing tool 10 to don a sock. A pair of parallel slots 44 may also be formed along the length of elongated support 12, for use in securing labels or other packaging material to the tool 10, or for hanging from a display or the like.

Figure 3:
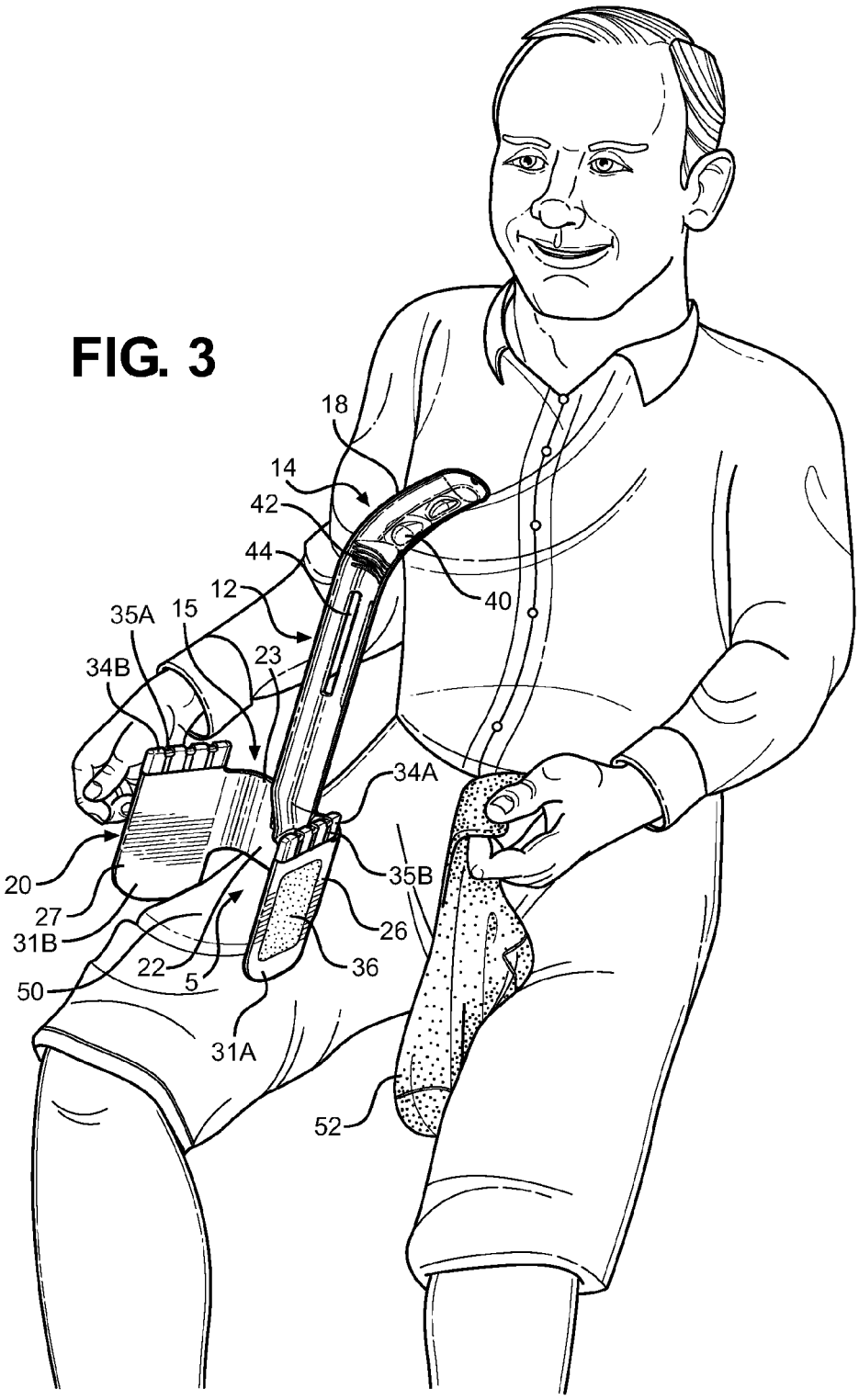
FIG. 3 depicts a first position for use in mounting a sock onto the tool of the present invention.
Figure 4:
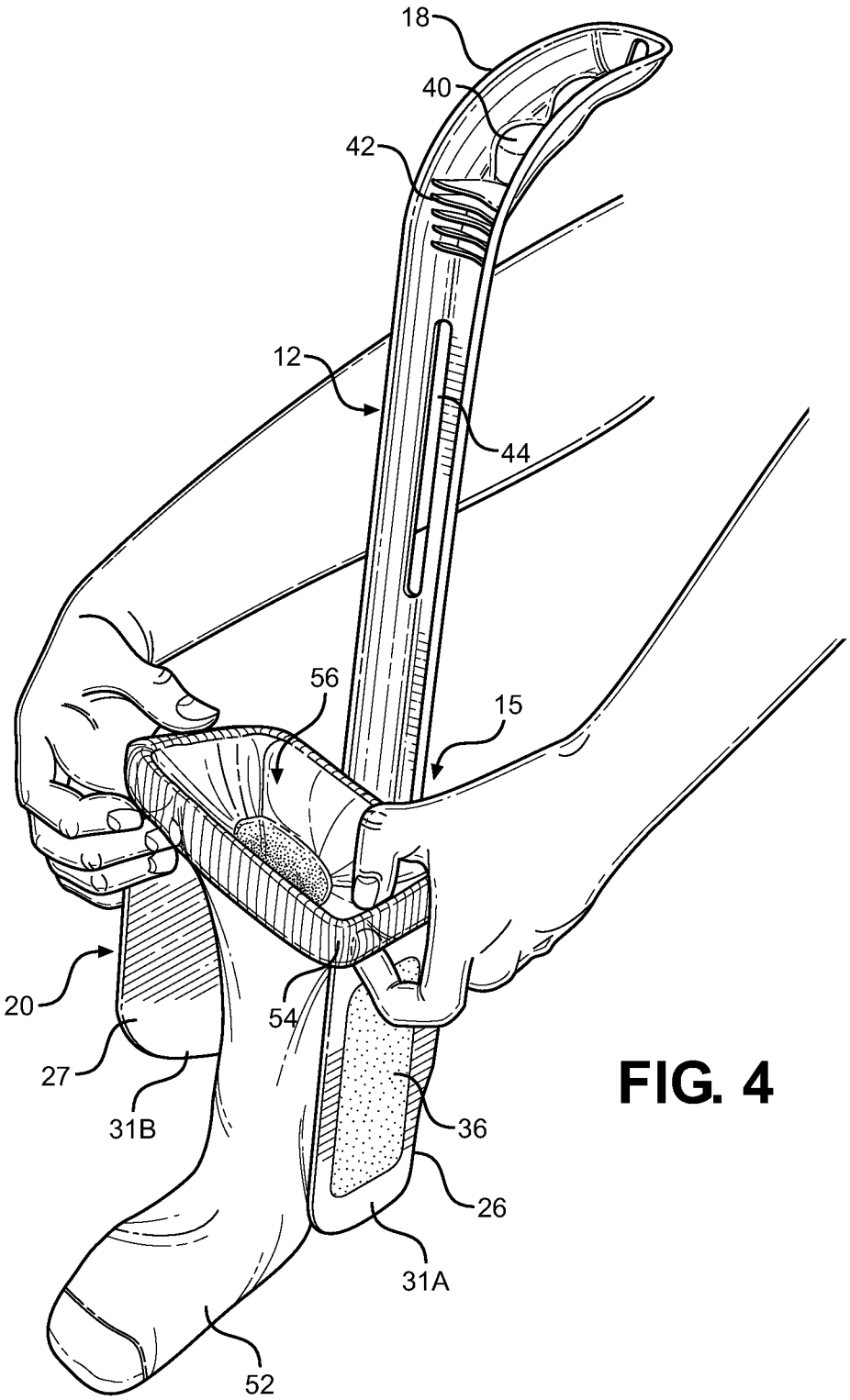
FIG. 4 is a perspective view of the tool of the present invention with a sock mounted thereon.

The manner in which tool 10 is intended to be utilized will now be discussed with reference to FIGS. 3-6. As depicted in FIG. 3, a user initially rests opposing stabilizing arms 31*a* and 31*b* on an upper portion of their thigh 50. As noted above, the distance between first and second flanges 26 and 27 enables tool 10 to rest in a stable manner on a user's thigh 50. At the same time, handle portion 18 rests against the torso of the user. With the tool 10 thus secured, a user then positions a sock 52 within space S and, stretching sock 52 gently, folds an outer upper portion 54 of sock 52 over first and second sock gripping portions 34*a* and 34*b*. As depicted in FIG. 4, sock 52 is only secured to sock engagement arms 30*a* and 30*b* of tool 10 by upper folded portion 54. The tension of the stretched upper portion 54, along with the high friction nature of first and second sock gripping portions 34*a* and 34*b*, retain sock 52 in place on tool 10 in an open configuration. It is important to note that sock 52 is held by sock engagement arms 30*a* and 30*b* in a spaced position from elongated support 12. With this configuration, sock 52 is held suspended within space S such that, when a user inserts a foot into sock 52, the sock 52 may stretch in all directions within space S.

Figure 5:
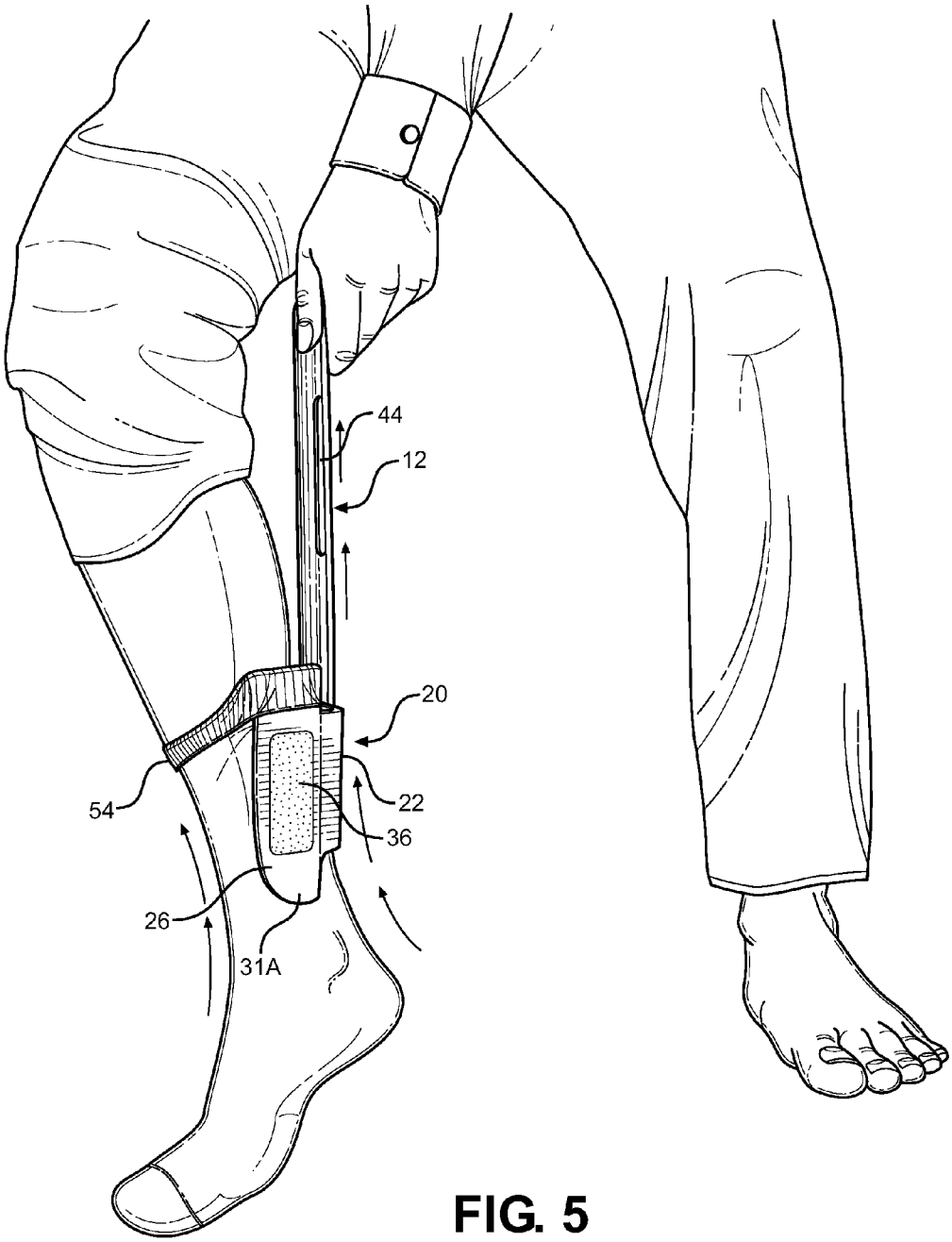
FIG. 5 is a perspective view of the tool in use.
Figure 6:
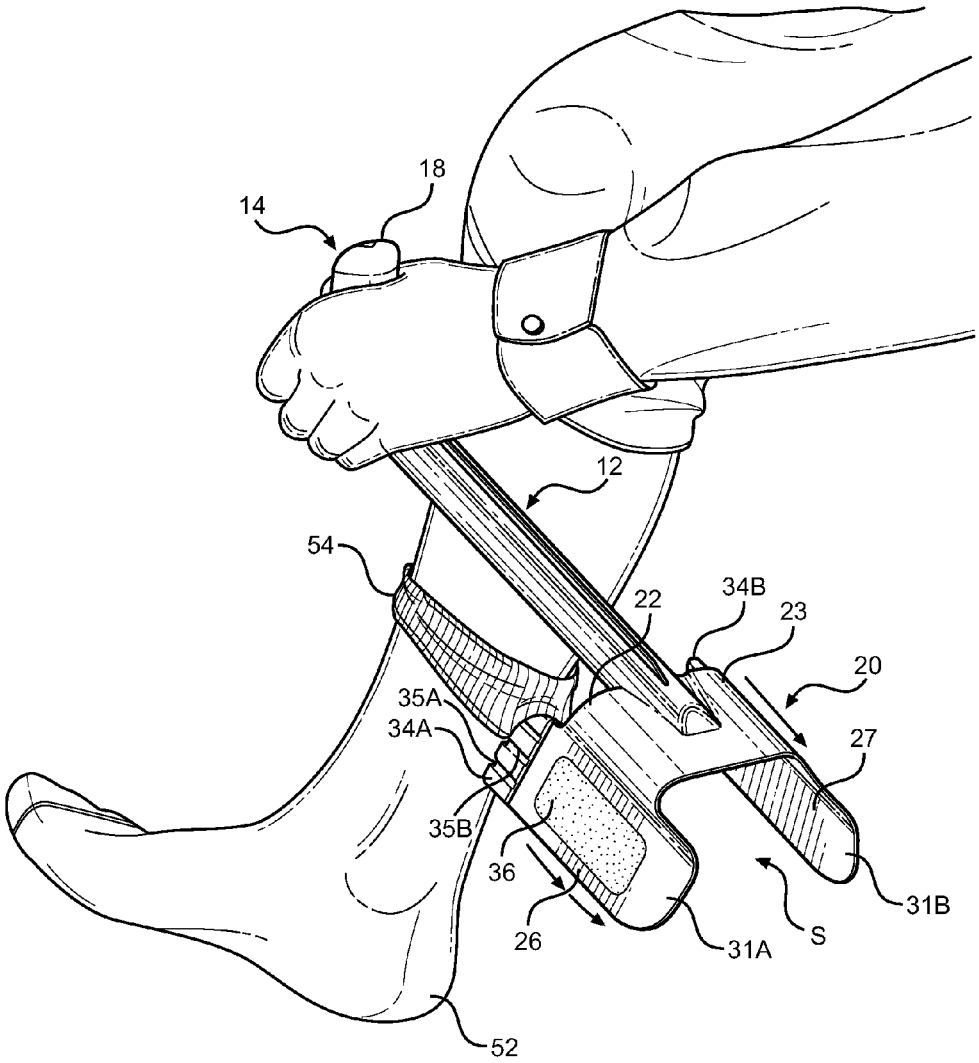
FIG. 6 is a perspective view of the tool as it is disengaged from a donned sock.

Next, gripping the handle portion 18, a user extends tool 10 and, with minimal bending, slides his or her toes through an opening 56 of sock 52. It should be understood that the ergonomic hand contours or ridges 40, with ribbed thumb grip 42, allow a user to lower tool 10 to the level of their foot without bending and while easily maintaining control of tool 10. First and second opposing flanges 26 and 27 act as a guide for the user to insert their foot through opening 56 of sock 52. The user then pulls handle portion 18 towards their torso while sliding their foot down into sock 52, thereby sliding sock 52 onto their foot, as best shown in FIG. 5. When sock 52 is positioned to a user's satisfaction, the user simply pivots handle portion 18 of tool 10 forward with respect to sock engagement portion 20, whereby sock gripping portions 34*a* and 34*b* will slide out from under outer upper portion 54 of sock 52, releasing the sock 52 from tool 10. See FIG. 6.

Figure 7:
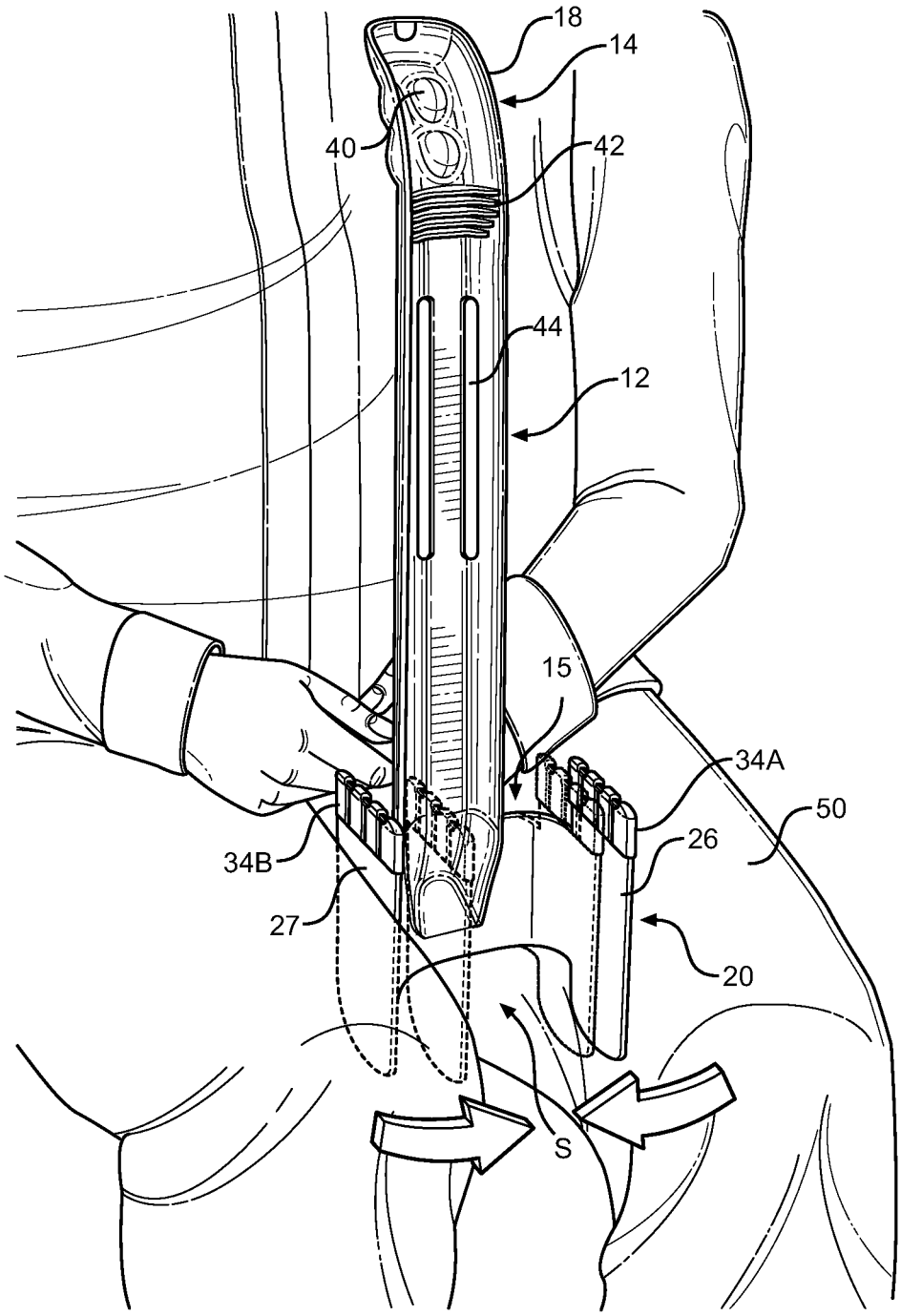
FIG. 7 is a second position for use in mounting a sock onto the tool of the present invention.

In an alternative mounting method depicted in FIG. 7, tool 10 is placed between a user's thighs 50, whereby textured surfaces 36 contact the user's thighs to reduce slippage, and the user squeezes first and second flanges 26 and 27 towards one another with their thighs. The flexible nature of sock engaging portion 20 enables flanges 26 and 27 to be brought closer together to make it easier for a user to mount sock 52 onto sock engagement arms 30 and 30*b* of respective flanges 26 and 27. This method may be useful where sock 52 is small or less elastic, or where a user's hand strength is not adequate to stretch the top of sock 52 over the fully extended flanges 26 and 27. Once sock 52 is mounted to tool 10 using this method, the user proceeds with putting on sock 52 as outlined above.

Figure 8:
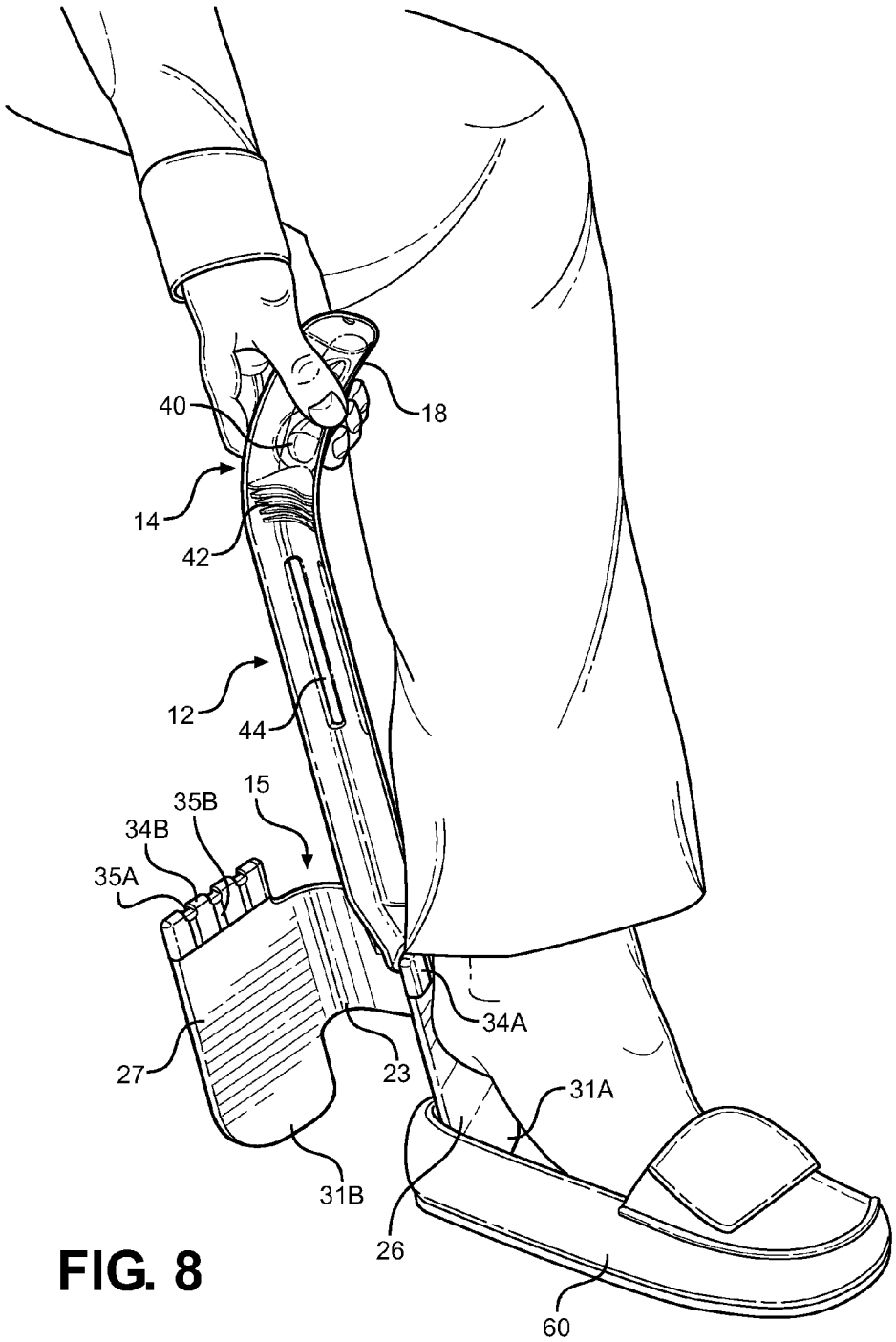
FIG. 8 is a perspective view of the tool of the present invention being utilized as a shoe horn.

An additional benefit of the present invention is the ability of tool 10 to be utilized as a shoe horn, as depicted in FIG. 8. More particularly, a user may turn tool 10 sideways, insert one of the first and second flanges 26 and 27 into a shoe 60, and slide their heel down the outer surface of the selected flange 26 or 27 until their heel is within the shoe 60, whereby the user then removes the selected flange 26 or 27.

As should be understood from the discussion above, the long handled sock donning tool 10 of the present invention advantageously allows a user to stabilize tool 10 against their body during mounting of a sock 52 on tool 10. Further, the manner in which sock gripping portions 34*a* and 34*b* secure only an upper folded portion 54 of a sock 52, in combination with the curved nature of tool 10, allows a user to easily release upper folded portion 54 of sock 52 from tool 10 once a user has donned sock 52, with minimal bending or twisting on the part of the user. Further, unlike other sock donning tools wherein the user's foot, especially the heel of the foot, is forced hard against the bare plastic of the tool, the present invention allows for stretching of the sock in all directions such that the foot can be inserted into the sock comfortably without being forced into contact with a hard plastic wall of the tool.

Although described with reference to a preferred embodiment of the invention, it should be readily understood that various changes and/or modifications can be made to the invention without departing from the spirit thereof. In general, the invention is only intended to be limited by the scope of the following claims.

We claim:

1. A long handled sock donning tool comprising:

an elongated support having a first end and a second end;

a handle portion, adapted to be gripped by a user, located at the first end of the elongated support;

a sock engaging portion located at the second end of the elongated support, the sock engaging portion including:

first and second spacers extending from opposing sides of the second end of the elongated support;

first and second flanges spaced from the elongated support by the first and second spacers, the first and second flanges each including a sock engagement arm and an opposing stabilizing arm which each extend beyond the respective first and second spacers, wherein the first and second opposing flanges and the first and second spacers define a space there between for the insertion of a user's foot, and the longitudinal axes of the first and second flanges extend in the same direction as a longitudinal axis of the elongated support; and first and second sock gripping portions extending over respective sock engagement arms of the first and second flanges;

wherein the first and second sock gripping portions are spaced from the elongated support by said first and second spacers such that, in use, when a top portion of a sock is folded over the first and second sock gripping portions, the sock is held away from the elongated support.

2. The long handled sock donning tool of claim 1, wherein the handle portion is curved in a first direction away from a longitudinal axis of the elongated support, and the sock engaging portion extends in a second direction away from the longitudinal axis of the elongated support opposite the first direction.

3. The long handled sock donning tool of claim 1, wherein the handle, elongated support and sock engaging portion are formed from a unitary piece of plastic.

4. The long handled sock donning tool of claim 1, wherein the handle includes ridges formed therein to facilitate gripping of a handle by a user's fingers.

5. The long handled sock donning tool of claim 1, wherein the elongated support includes a generally u-shaped cross-section.

6. The long handled sock donning tool of claim 1, wherein a distance between the stabilizing arms of the respective first and second flanges is at least 12.7 cm such that, during use, the opposing first and second stabilizing arms are adapted to engage a user's thigh to stabilize the long handled sock donning tool while a user mounts a sock on the sock engaging portion.

7. The long handled sock donning tool of claim 1, wherein the length of the long handled sock donning tool from the handle to the stabilizing arms of the respective first and second flanges is at least 44.45 cm.

8. The long handled sock donning tool of claim 1, wherein the first and second flanges are flexible to enable a user to squeeze the first and second flanges between the user's respective thighs and reduce the space between the sock engagement arms of the respective first and second flanges.

9. The long handled sock donning tool of claim 1, further comprising:

a ribbed thumb grip located on the handle portion.

10. The long handled sock donning tool of claim 1, further comprising:

a textured portion located on the outer wall of each of the first and second flanges.

11. The long handled sock donning tool of claim 1, wherein the sock gripping portions are formed with ridges and channels therein.

12. A method of utilizing a long handled sock donning tool including an elongated support having a first end and a second end, a handle portion, adapted to be gripped by a user, located at the first end of the elongated support, a sock engaging portion located at the second end of the elongated support; the sock engaging portion including first and second spacers extending from opposing sides of the second end of the elongated support, first and second flanges spaced from the elongated support by the first and second spacers, the first and second flanges each including a sock engagement arm and an opposing stabilizing arm which each extend beyond the respective first and second spacers, wherein the first and second opposing flanges and the first and second spacers define a space there between for the insertion of a user's foot, and first and second sock gripping portions extending over respective sock engagement arms of the first and second flanges, the method comprising:

positioning the stabilizing arms on an upper portion of the user's thigh;

resting the handle portion against a torso of the user;

folding an outer upper portion of a sock over first and second sock gripping portions to secure the sock to the tool, wherein the first and second sock gripping portions are spaced from the elongated support by said first and second spacers such that the sock is held away from the elongated support;

while gripping the handle portion, extending the tool towards a user's foot;

sliding a user's foot into an opening of the sock;

pulling the handle portion towards the user's torso, thereby sliding the sock onto the user's foot;

pivoting the handle portion forward with respect to the sock engagement portion such that the sock gripping portions slide out from under the outer upper portion of the sock, thereby releasing the sock from the tool.

13. A method of utilizing a long handled sock donning tool including an elongated support having a first end and a second end, a handle portion, adapted to be gripped by a user, located at the first end of the elongated support, a sock engaging portion located at the second end of the elongated support; the sock engaging portion including first and second spacers extending from opposing sides of the second end of the elongated support, first and second flanges spaced from the elongated support by the first and second spacers, the first and second flanges each including a sock engagement arm and an opposing stabilizing arm which each extend beyond the respective first and second spacers, wherein the first and second opposing flanges and the first and second spacers define a space there between for the insertion of a user's foot, and first and second sock gripping portions extending over respective sock engagement arms of the first and second flanges, the method comprising:

positioning the stabilizing arms between a user's thighs, with the handle portion extending towards the torso of the user;

squeezing the stabilizing arms towards one another with the user's thighs;

folding an outer upper portion of a sock over first and second sock gripping portions to secure the sock to the tool, wherein the first and second sock gripping portions are spaced from the elongated support by said first and second spacers such that the sock is held away from the elongated support;

while gripping the handle portion, extending the tool towards a user's foot;

sliding a user's foot into an opening of the sock;

pulling the handle portion towards the user's torso, thereby sliding the sock onto the user's foot;

pivoting the handle portion forward with respect to the sock engagement portion such that the sock gripping portions slide out from under the outer upper portion of the sock, thereby releasing the sock from the tool.

* * * * *